US008577236B2

(12) United States Patent
Willard et al.

(10) Patent No.: US 8,577,236 B2
(45) Date of Patent: Nov. 5, 2013

(54) REDUCING RELOAD IMAGE QUALITY DEFECTS

(75) Inventors: W. Bradford Willard, Fairport, NY (US); Brian Robert Conrow, Webster, NY (US); Kimberly Anne Stoll, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 492 days.

(21) Appl. No.: 12/634,822

(22) Filed: Dec. 10, 2009

(65) Prior Publication Data

US 2011/0142466 A1 Jun. 16, 2011

(51) Int. Cl.
*G03G 15/06* (2006.01)

(52) U.S. Cl.
USPC ..... 399/55

(58) Field of Classification Search
USPC ..... 399/55
See application file for complete search history.

(56) References Cited

U.S. PATENT DOCUMENTS

| | | | | |
|---|---|---|---|---|
| 5,031,570 | A | 7/1991 | Hays et al. | |
| 5,666,619 | A | 9/1997 | Hart et al. | |
| 5,890,042 | A | 3/1999 | Wong et al. | |
| 6,035,153 | A * | 3/2000 | Yamawaki et al. | 399/58 |
| 6,122,075 | A * | 9/2000 | Yamada et al. | 358/446 |
| 7,024,126 | B2 * | 4/2006 | Kellie et al. | 399/57 |
| 7,103,294 | B2 * | 9/2006 | Kawano | 399/55 |
| 7,220,526 | B2 * | 5/2007 | Oshiba et al. | 430/124.33 |
| 7,483,644 | B2 * | 1/2009 | Uchiyama et al. | 399/37 |
| 2002/0122673 | A1 * | 9/2002 | Sakai et al. | 399/27 |
| 2006/0008281 | A1 * | 1/2006 | Matsumoto et al. | 399/27 |
| 2006/0216045 | A1 * | 9/2006 | Ramesh et al. | 399/27 |
| 2006/0222390 | A1 * | 10/2006 | Sasaki et al. | 399/55 |
| 2007/0077076 | A1 * | 4/2007 | Yoshida | 399/27 |
| 2007/0242985 | A1 * | 10/2007 | Aoki et al. | 399/274 |
| 2007/0286617 | A1 * | 12/2007 | Tanaka et al. | 399/30 |
| 2008/0089717 | A1 * | 4/2008 | Burry et al. | 399/236 |
| 2008/0124108 | A1 * | 5/2008 | Tokuyama et al. | 399/62 |
| 2008/0232863 | A1 * | 9/2008 | Saiki | 399/285 |
| 2009/0003891 | A1 * | 1/2009 | Fujishima et al. | 399/284 |
| 2009/0123856 | A1 * | 5/2009 | Hotta et al. | 430/106.1 |
| 2009/0202260 | A1 * | 8/2009 | Morikuni et al. | 399/27 |
| 2009/0252515 | A1 * | 10/2009 | Hotogi et al. | 399/55 |
| 2010/0054820 | A1 * | 3/2010 | Fujihara et al. | 399/270 |
| 2010/0226675 | A1 * | 9/2010 | Shiraki et al. | 399/55 |

FOREIGN PATENT DOCUMENTS

| | | | |
|---|---|---|---|
| JP | 2000112212 A | * | 4/2000 |
| JP | 2001027838 A | * | 1/2001 |

OTHER PUBLICATIONS

Machine translation of JP 2001027838.*
Machine translation of JP 2000112212.*

* cited by examiner

*Primary Examiner* — Walter L Lindsay, Jr.
*Assistant Examiner* — David Bolduc
(74) *Attorney, Agent, or Firm* — Oliff & Berridge, PLC

(57) ABSTRACT

An image forming apparatus includes a sensor that is configured to detect a property of a developer material, a transport unit that is operatively in contact with the developer material and that is configured to move the developer material toward a recording medium, and a controller that receives the property of the developer material from the sensor unit and sets a voltage of the transport unit, wherein the voltage is determined based on the property of the developer material received from the sensor.

22 Claims, 6 Drawing Sheets

REDUCING RELOAD IMAGE QUALITY DEFECTS

BACKGROUND

This disclosure is generally directed to electrostatographic imaging devices. More specifically, this disclosure is directed to reducing or eliminating the image quality defect known as reload.

In the known process of electrostatographic printing, a charge retentive surface, typically known as a photoreceptor, is electrostatically charged and then exposed to a pattern of activating electromagnetic radiation, such as light. The radiation selectively dissipates the charge on the illuminated areas of the charge retentive surface while leaving behind an electrostatic image on the non-illuminated surfaces. The resulting pattern of charged and discharged areas on the photoreceptor form an electrostatic charge pattern, known as a latent image, conforming to the original image.

The latent image is then developed by contacting it with an electrostatically attractable toner. Toner is held on the image areas by the electrostatic charge on the photoreceptor surface. Thus, a toner image is produced in conformity with a light image of the image being produced. The toner image may then be transferred to a substrate or recording medium, and the image is fixed to form a permanent record of the image. Subsequent to development, excess toner left on the charge retentive surface is cleaned from the surface. The process is useful for copying from an original or printing electronically generated or stored originals.

In the operation of electrostatographic printing there arises a defect known as reload. Reload describes a situation where a roller within a development station fails to properly and completely be reloaded with the appropriate amount of toner after one cycle through the development process in preparation for the next cycle. Reload becomes more and more drastic when a machine engaging in electrostatographic image production is used to produce large quantities of images at high speeds.

REFERENCES

In U.S. Pat. No. 5,031,570, there is disclosed an apparatus for developing latent electrostatic images on a charge retentive surface with toner. The apparatus can include a supply of two-component developer having toner and carrier beads, a developer transport structure spaced from the charge retentive surface for conveying developer from the supply of developer to an area opposite the charge retentive surface without contacting the surface, an electrode structure, a device for establishing an alternating electrostatic field between the developer transport structure and the electrode structure for creating a cloud of toner proximate the electrode structure. The electrode structure can include a plurality of wires operatively connected to an AC power source and being positioned in a space between the charge retentive surface and developer transport structure, a device for creating an electrostatic field between the charge retentive surface and the electrode structure for effecting movement of toner from the cloud of toner to the latent electrostatic images. The transport structure can include a magnetic brush structure having its north and south poles arranged such that the magnetic field established in the space is ineffective to cause the developer to contact the charge retentive surface, and a plurality of unbiased wires supported for agitation of the developer on the magnetic brush structure.

In U.S. Pat. No. 5,666,619, there is disclosed an apparatus for developing a latent image recorded on a surface. The device can include a housing defining a chamber storing a supply of developer material therein, a donor roll spaced from the surface and adapted to transport the developer material to a development zone adjacent the surface, a donor roll shaft on which the donor roll is mounted, a donor roll support, the donor roll shaft being rotatably mounted in the donor roll support, an electrode wire positioned in the space between the surface and the donor roll. The electrode wire can be electrically biased to detach the developer material from the donor roll to form a cloud of developer material in the space between the electrode wire and the surface with the developer material developing the latent image. The device can also include a wire module providing a device for attaching the ends of the wire and tensioning the electrode wire, and a device for supporting the electrode wire along the length of the wire. The supporting device can be rotatably mounted with respect to the donor roll and located along the donor roll shaft between each end of the donor roll and the donor roll support and having a wire support surface which supports the wire in the vertical direction when the electrode wire is positioned in the space between the surface and the donor roll. The support device can have two support legs separated by an open section, the open section allowing the support device to fit over the donor roll shaft, the two legs of the support means are attached to the housing.

In U.S. Pat. No. 5,890,042, there is disclosed an apparatus for developing a latent electrostatic image on a charge retentive surface with toner. The apparatus can include a supply of toner, a donor structure spaced from the charge retentive surface for conveying toner from the supply of toner to an area adjacent the charge retentive surface. The donor structure can have a continuous surface, and a device for applying an alternating current directly to the donor structure to create an alternating electrostatic field between the donor structure and the charge retentive surface to produce a toner cloud adjacent the charge retentive surface for developing the latent electrostatic image thereon.

SUMMARY

Reload defects can be reduced or eliminated in an image forming apparatus where the AC potential across a transport roll is varied depending on a property of the developer material.

The disclosure provides an image forming apparatus including a sensor that can be configured to detect a property of a developer material, a transport unit that can be operatively in contact with the developer material and that can be configured to move the developer material toward a recording medium, and a controller that can receive the property of the developer material from the sensor unit. The controller may further set a voltage of the transport unit. The voltage can be determined based on the property of the developer material received from the sensor.

Further, the disclosure provides a system for forming an image including a means for detecting a property of a developer material, a means for moving the developer material towards a recording medium, and a means for setting a voltage of the means for moving the developer material based on the property of the developer material received from the means for detecting.

Further, the disclosure provides a method for forming an image including detecting a property of a developer material, moving the developer material towards a recording medium, and setting a voltage of a transport unit based on the value of the property of the developer material.

EMBODIMENTS

Figure 1:
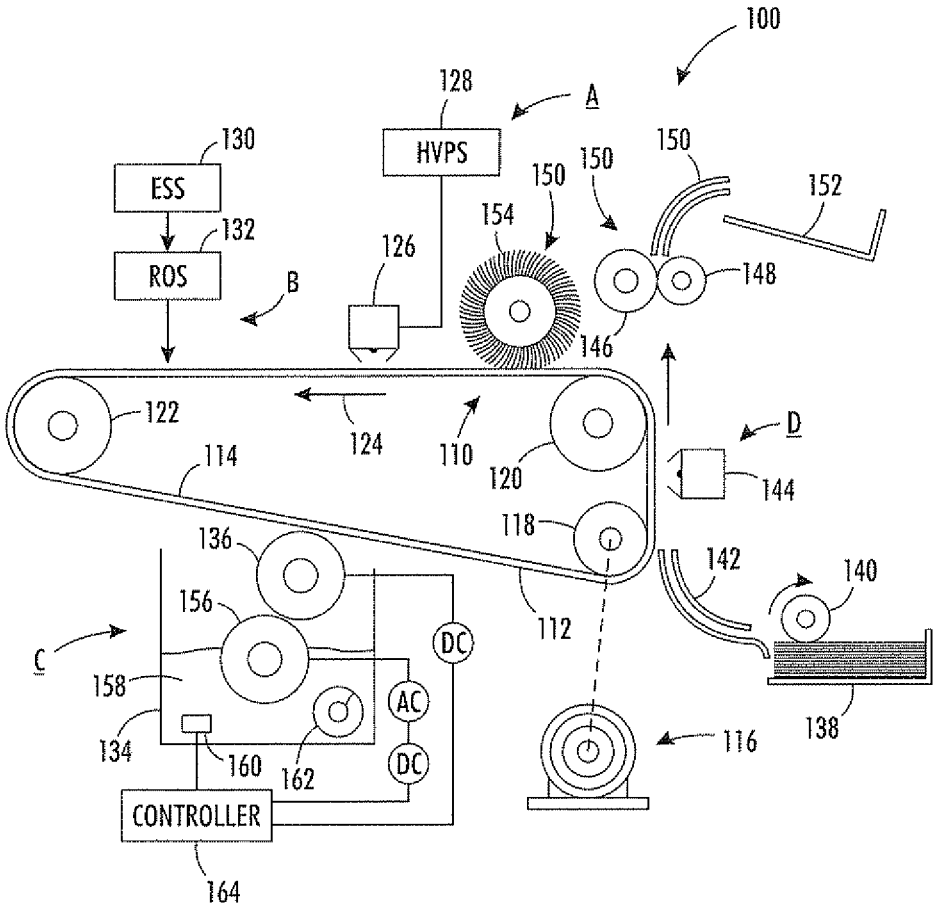
FIG. 1 shows an exemplary electrostatographic printing apparatus.

FIG. 1 shows an exemplary electrostatographic printing apparatus 100 having an image forming apparatus. The printing apparatus 100 can include a photoreceptor, shown as a belt 110 having a photoconductive surface 112 on an electroconductive substrate 114. The belt 110 can be driven by a motor 116 along a path defined by rollers 118, 120, and 122, in the direction shown by arrow 124. Initially, a portion of the belt 110 can pass through a charge station A where a corona generating device 126 may charge photoconductive surface 112 to a substantially uniform potential. A high voltage power supply 128 may be connected to corona generating device 126. After charging, the charged area can be passed to exposure station B.

At exposure station B, an electronic subsystem (ESS) 130 can receive image signals representing the desired output image and processes these signals to convert them to a continuous tone rendition of the image. The continuous tone rendition can be transmitted to a modulated output generator, for example the raster output scanner (ROS) 132. Generally, the ESS 130 can be a self-contained, dedicated minicomputer, however, it should be understood that the ESS 132 may take any form. The image signals transmitted to the ESS 132 may originate from a raster input scanner (RIS) (not illustrated) or from a computer, thereby enabling the electrostatographic printing apparatus 100 to serve as a machine for copying original documents or as a printer for one or many computers, remote or locally.

For use as a copier, an original document may be positioned in a document handler of an RIS. The RIS can include document illuminations lamps, optics, a mechanical scanning drive and a charge-coupled device (CCD). The RIS can capture the original document and convert it to a series of raster scan lines. The information can be transmitted to the ESS 130, which can control the ROS 132 as described above.

The signals from the ESS 130, which correspond to the continuous tone image desired to be produced by the printing apparatus 100, can be transmitted to the ROS 132. The ROS 132 can include a laser with rotating mirror blocks. The ROS 132 can expose the photoconductive surface 112 to record an electrostatic latent image corresponding to the continuous tone image received from the ESS 130. Alternatively, the ROS 132 may contain a linear array of light emitting diodes arranged to illuminate the charged portion of the photoconductive surface 112 on a raster-by-raster basis or any other technique to record a latent image on the photoconductive surface 112.

After the electrostatic latent image has been recorded on the photoconductive surface 112, belt 110 can advance the latent image to development station C. At development station C, a development system can be disposed in a housing 134 and develop the latent image recorded on the photoconductive surface 112. The development system can include a donor roll 136 positioned near to the photoconductive surface 112. The donor roll 136 can be mounted, at least partially, in the housing 134 where a developer material 158 can be supplied.

The developer material 158 can be any material that creates an image on a recording medium. For example, the developer material can be a one-component developer material of triboelectrically charged toner, or a two-component developer material of at least magnetic carrier granules triboelectrically connected to toner particles. An auger 162 can be situated at the bottom of the housing 134 and can distribute the developer material 158 evenly along the length of the housing 134.

A transport roller 156 can be disposed within the housing 134 and can convey the developer material 158 to the donor roll 136. The transport roll 156 can be electrically biased relative to the donor roll 136 so that the toner particles are attracted from the transport roll 158 to the donor roll 136. The toner can be further electromagnetically detached from the donor roll 136 so as to form a toner powder cloud in the space between the donor roll 136 and the photoconductive surface 112. The latent image attracts toner particles from the toner powder cloud to form a toner powder image on the photoconductive surface 112.

A sensor 160 can detect, continuously or at a predetermined interval, a property of the developer material 158, and can be situated within the housing 134. The sensor can send, continuously or at a predetermined interval, the property detected to a controller 164 disposed within the printing apparatus 100. Based on the property, the controller 164 can vary the voltage applied to the transport roll 156. By doing so, the controller 164 can account for varying properties of the developer material 158, and thereby maintain high printing quality.

After the electrostatic image has been developed, the belt 110 can advance the developed image to transfer station D, where a recording medium 138 can be advanced by roll 140 and guides 142 into contact with the developed image on belt 110. A corona generating device 144 can be used to spray ions onto the back of the recording medium 138 to attract the toner image from the belt 110 to the recording medium 138. As the belt 110 turns around roller 120, the recording medium 138 can be stripped from the belt 110 now having the toner image on its surface.

After transfer, the recording medium 138 can be advanced to fusing station E. Fusing station E can include a heated fusing roller 146 and a back-up roller 148. The recording medium 138 can pass between fuser roller 146 and back-up roller 148 with the toner powder image contacting fuser roller 146. Here, the toner image can be permanently affixed to the recording medium 138. After fusing, the recording medium 138 can advance through chute 150 to catch tray 152 for subsequent removal.

After the recording medium has been separated from the surface 112 of the belt 110, the residual toner particles left adhering to the photoconductive surface 112 can be removed at cleaning station F by a rotatably mounted fibrous brush 154, or any similar cleaning device in contact with the photoconductive surface 112. After cleaning, a discharge lamp (not shown) can flood the photoconductive surface 112 with light to dissipate any residual electrostatic charge remaining prior to its charging for the next successive imaging cycle.

During operation, the controller 164 can set a direct current potential $Vdr_{DC}$ of the donor roll 136, a direct current potential $Vtr_{DC}$ of the transport roll 156, and an alternating current potential $Vtr_{AC}$ of the transport roll 156. The potentials $Vdr_{DC}$ of the donor roll 136 and $Vtr_{DC}$ of the transport roll 156 can be set to predetermined potentials. The potential $Vtr_{AC}$ of the transport roll 156 can be variably set, continuously or at predetermined intervals, by the controller 164 based on the property detected by the sensor 160.

In embodiments that use a two-component developer material, the developer material 158 may include a quantity of magnetic carrier beads in addition to the toner particles intended to adhere to the photoconductive surface 112. The toner particles can adhere triboelectrically to the relatively large carrier beads, which may be made of steel. When the developer material 158 is placed in a magnetic field, the carrier beads with the toner particles thereon can form a magnetic brush. Here, the carrier beads may form relatively long chains, which resemble the fibers of a brush upon the transport roller 156. The carrier beads can form chains extending from the surface of the transport roll 156, and the toner particles can be electrostatically attracted to those chains. When the magnetic brush is introduced into the development station C, the electrostatic charge on the photoconductive surface 112 can cause the toner particles to be pulled off the carrier beads and onto the photoconductive surface 112 in a case where no donor roll is utilized or the electrostatic charge on the donor roll 136 can cause the toner particles to be pulled off the carrier beads and onto the donor roll 136 in a case where a donor roll is utilized.

In embodiments that utilize a single-component developer material, the developer material 158 may consist entirely of toner, each toner particle can have both an electrostatic charge (to enable the particles to adhere to the photoconductive surface 112 in a case where no donor roll is utilized or to enable the particles to adhere to the donor roll 136 in a case where a donor roll is utilized) and magnetic properties (to allow the particles to be magnetically conveyed to the photoconductive surface 112 in a case where no donor roll is utilized or to allow the particles to be magnetically conveyed to the donor roll 136 in a case where a donor roll is utilized). Instead of using magnetic carrier beads to form a magnetic brush, the magnetized toner particles can be caused to adhere directly to the transport roll 156. In the development station C, the electrostatic charge on the photoconductive surface 112 can cause the toner particles to be pulled from the transport roll 156 in a case where no donor roll is utilized or the electrostatic charge on the donor roll 136 will cause the toner particles to be pulled from the transport roll 156 in a case where a donor roll is utilized.

Figure 2:
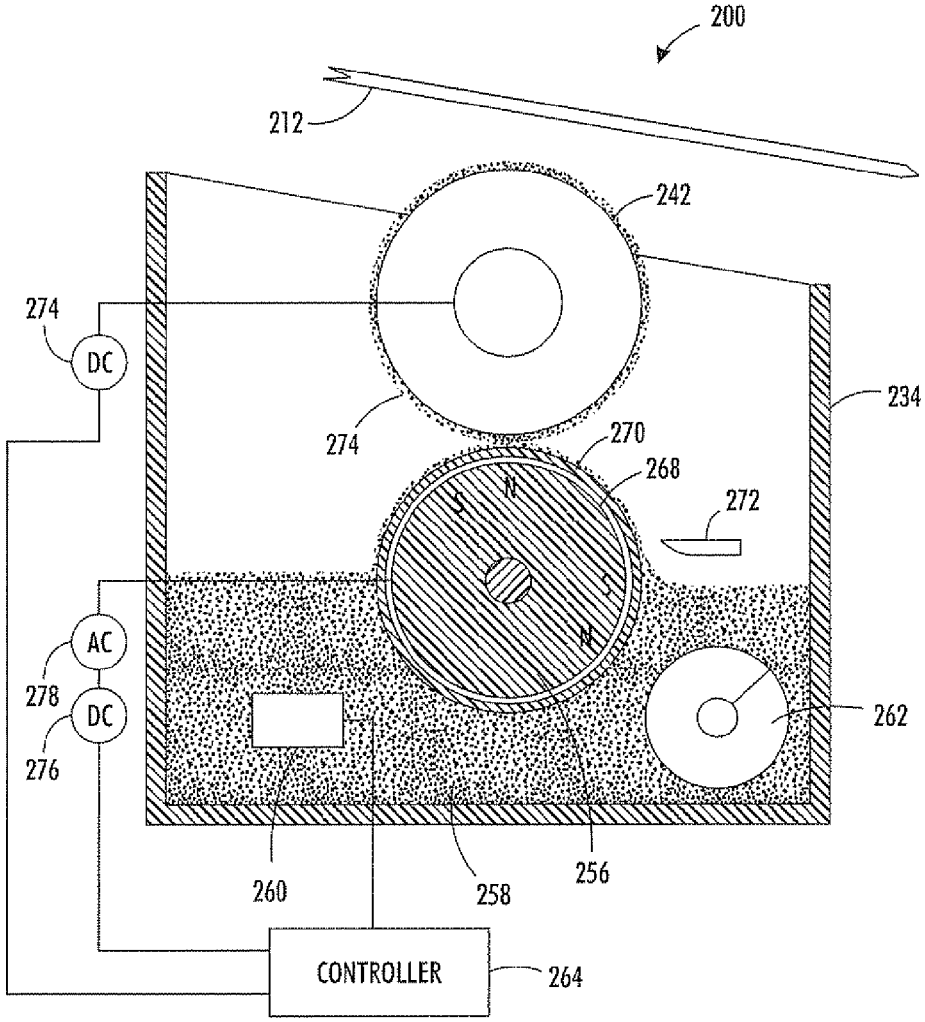
FIG. 2 shows a schematic view of the image processing apparatus disclosed herein.

FIG. 2 shows a developing station 200 for developing a latent image on photoconductive surface 212 with developer material 258 in greater detail. The housing 234 can define a chamber for holding a supply of developer material 258. Positioned within the housing 234 can be an auger 262 which can distribute the developer material 258 throughout the housing 234 to enable uniform coverage along the length of a transport roll 256. The transport roll 256 can be positioned within the housing 234 such that the lowermost part of transport roll 256 can be continuously immersed in the supply of developer material 258.

The transport roll 256 can include a multi-polar magnet 268 and a sleeve 270 situated thereon. The sleeve 270 can be formed of a non-magnetic material, for example aluminum. The sleeve 270 can be designed to rotate about the multi-polar magnet 268. As the developer material 258 can include magnetic carrier granules in the case of a two-component developer material or electrostatically charged toner particles in the case of a one-component developer material, the rotation of the sleeve 270 through the magnetic field of the transport roll 256 causes the developer material 258 to be attracted from the supply within the housing 234 to the exterior of the sleeve 270. A blade 272 can be positioned in close proximity to the transport roll 256 to limit the radial depth of the developer material 258 that adheres to the transport roll 256.

The donor roll 236 can be positioned in close proximity to the transport roll 256 and kept at a continuous potential $Vdr_{DC}$ by a direct current power supply 274 in order to attract a thin layer of toner particles 277 from the transfer roll 256. The donor roll 236 may be fabricated of a material having low conductive properties. The material should be conductive enough to reduce or prevent any build up of electrical charge over time, yet insulative enough so as to prevent shorting or arcing between the magnetic carrier granules in the case of a two-component developer material or the transport roll 256.

The transport roll 256 can be kept at a continuous potential $Vtr_{DC}$ by a direct current power supply 276. The resulting DC electrical field created can enhance the attraction of the developer material 258 to the sleeve 270. The transport roll 256 can also be kept at a variable potential $Vtr_{AC}$ by an alternating current power supply 278. The resulting AC electrical field created can loosen the toner particles 277 from the magnetic carrier granules of the developer material 258 in the case of a two-component developer material or from the transport roll 256 in the case of a one-component developer material, facilitating the transfer of the toner from the transport roll 256 to the donor roll 236.

The potentials $Vtr_{AC}$, $Vtr_{DC}$, and $Vdr_{DC}$ may be managed by the controller 264. The controller 264 can manage potentials $Vtr_{DC}$, and $Vdr_{DC}$ based on predetermined values. The controller 264 can manage $Vtr_{AC}$ based on an at least one variable property of the developer material 258. For example, the controller 264 may receive a property of the toner within the developer material 258 from a sensor 260 that can be disposed within the housing 234 such that it is in contact with the developer material 258. In embodiments, the sensor 260 can detect a property that can be necessary for the calculation of the age of the toner within the developer material 258. The sensor 260 can send the property to the controller 264. In embodiments, the toner age can be determined by the controller 264 as a mean residence time of the toner within the developer material 258 in the housing 234. However, the age of the toner within the developer material 258 can be determined in various manners.

For example, to determine mean residence time of the toner within the developer material 158, the sensor 260 can sense the Toner Concentration (TC) of the toner within the developer material 258 by detecting a magnetic permeability of the toner particles. The sensor 260 can send the detected TC to the controller 264. The controller 264 can calculate the toner age (TA) as a function of a mass of the toner (™), an average amount of toner output (TO), the most recent value of toner age ($TA_{t-1}$) calculated by the controller 264, and a period (P). For example:

$$TA = (TM - TO) \cdot \frac{\left(TA_{t-1} + \frac{P}{60}\right)}{TM}$$

$$TM = TC \cdot C$$

$$TO = S_t \cdot \frac{PC}{100} \cdot PSF \cdot P$$

In the above, C can be a predetermined constant, $S_t$ can be a predetermined Solid Area Development Developed Mass Area target value, PC can be a pixel count, and PSF can be a predetermined page size factor. $S_t$ can be predetermined based on the types of toner used, the recording medium used, and the printing apparatus used. PC can be determined by the controller 264 based on image signals representing the desired output image similar to those that can be sent to the ESS (described above). C can be predetermined based on the amount of carrier material within developer material 258. For example, C can represent toner mass per percent toner concentration.

In embodiments, the controller 264 can use the Toner Concentration alone in determining the age of the toner within the developer material 258.

Figure 3:
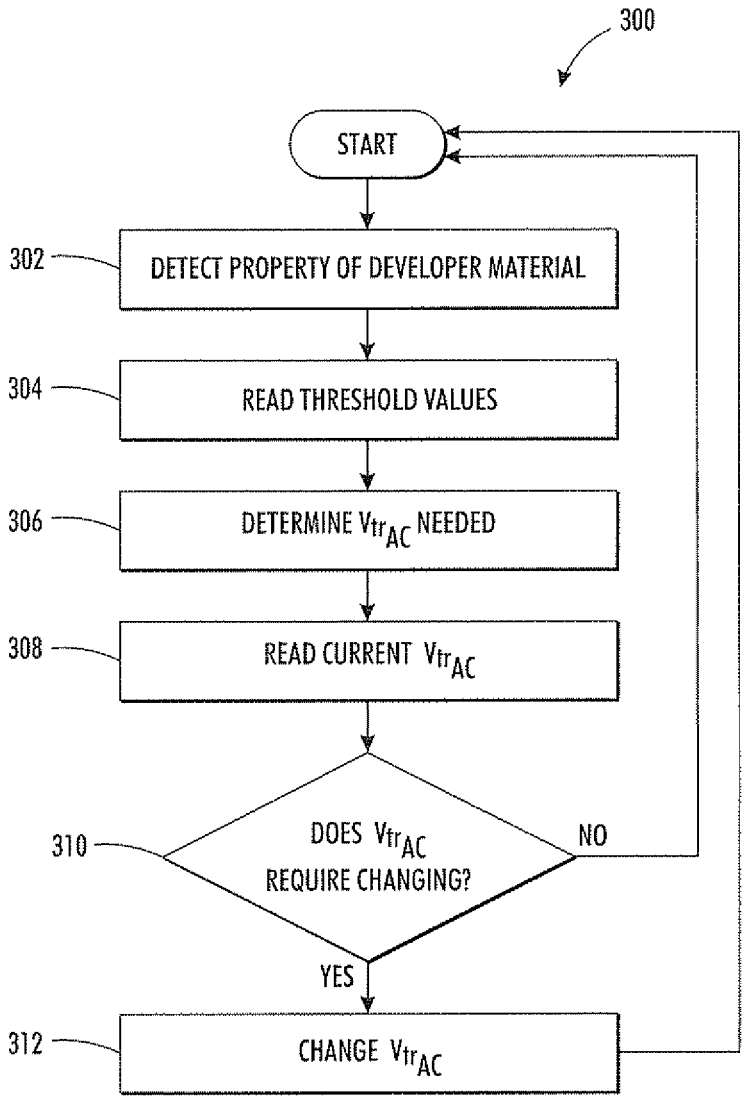
FIG. 3 shows a block diagram depicting the processes undertaken by the controller.

FIG. 3 shows the process 300 that may be taken by the controller 264 and the sensor 260 in the determination of and the setting of the variable alternating current potential $Vtr_{AC}$ of the transport roll 256. In step 302, the controller 264 may begin process 300 by directing the sensor 260 to detect and return a property of the developer material 258. In step 304, the controller 264 may read threshold values. In step 306, the controller 264 can use the property of the developer material 258 and the threshold values to determine the potential $Vtr_{AC}$ that is needed.

In step 308, the controller 264 can read the current potential $Vtr_{AC}$ of the transport roll 256. In step 310, the controller 264 may use the current potential $Vtr_{AC}$ 312 of the transport roll 256 and the potential $Vtr_{AC}$ needed, to determine if the current potential $Vtr_{AC}$ should be changed. For example, if the current potential $Vtr_{AC}$ is equal to or within an acceptable range of the potential $Vtr_{AC}$ needed, then it may be determined by the controller 264 that the potential $Vtr_{AC}$ does not need to be changed. If the controller 264 determines that the current potential $Vtr_{AC}$ should be changed to the newly determined needed potential, it may do so in step 312 and may begin the process 300 again, continuously or at predetermined intervals. Further, if the controller 264 determines that the current potential $Vtr_{AC}$ may remain the same, it may forego step 312 and being the process 300 again, continuously or at predetermined intervals.

Figure 4A:
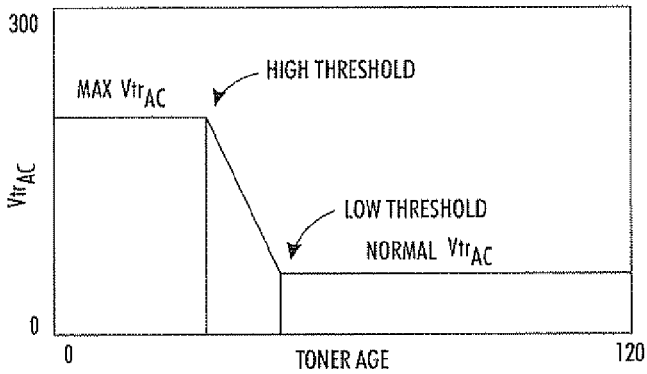
FIGS. 4A-4C illustrate relationships between voltage and toner age.

The threshold values may be predetermined specific to the property to be used by the controller 264 for determining the needed potential $Vtr_{AC}$ of the transport roller 256. In embodiments, when toner age is the property being used, the potential $Vtr_{AC}$ may be set by the controller 264 at a maximum potential when the age of the toner within the developer material 258 is less than a high threshold. The potential $Vtr_{AC}$ may be set by the controller 264 at a nominal potential when the age of the toner within the developer material 258 is greater than a low threshold. When age of the toner within the developer material 258 is between the high and the low thresholds, the controller 264 can linearly decrease the potential $Vtr_{AC}$ as the age of the toner within developer material 258 increases. This exemplary relationship between toner age and potential $Vtr_{AC}$ of the transport roll is shown in FIG. 4A.

Figure 4B:
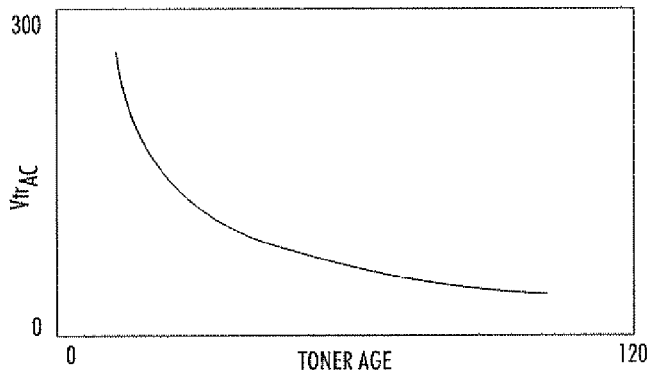
Figure 4C:
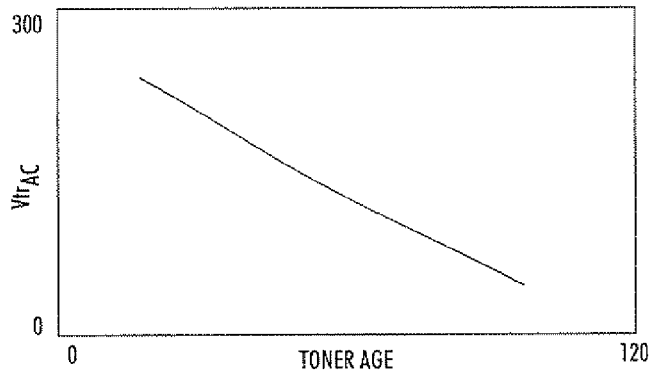

In embodiments, the controller 264 can exponentially decrease the potential $Vtr_{AC}$ as the age of the toner within the developer material 258 increases. This relationship between toner age and potential $Vtr_{AC}$ of the transport roll is shown in FIG. 4B. Further, in embodiments, the controller 264 can linearly decrease the potential $Vtr_{AC}$ as the age of the toner within the developer material 258 increases. This relationship between toner age and potential $Vtr_{AC}$ of the transport roll is shown in FIG. 4C.

Figure 5:
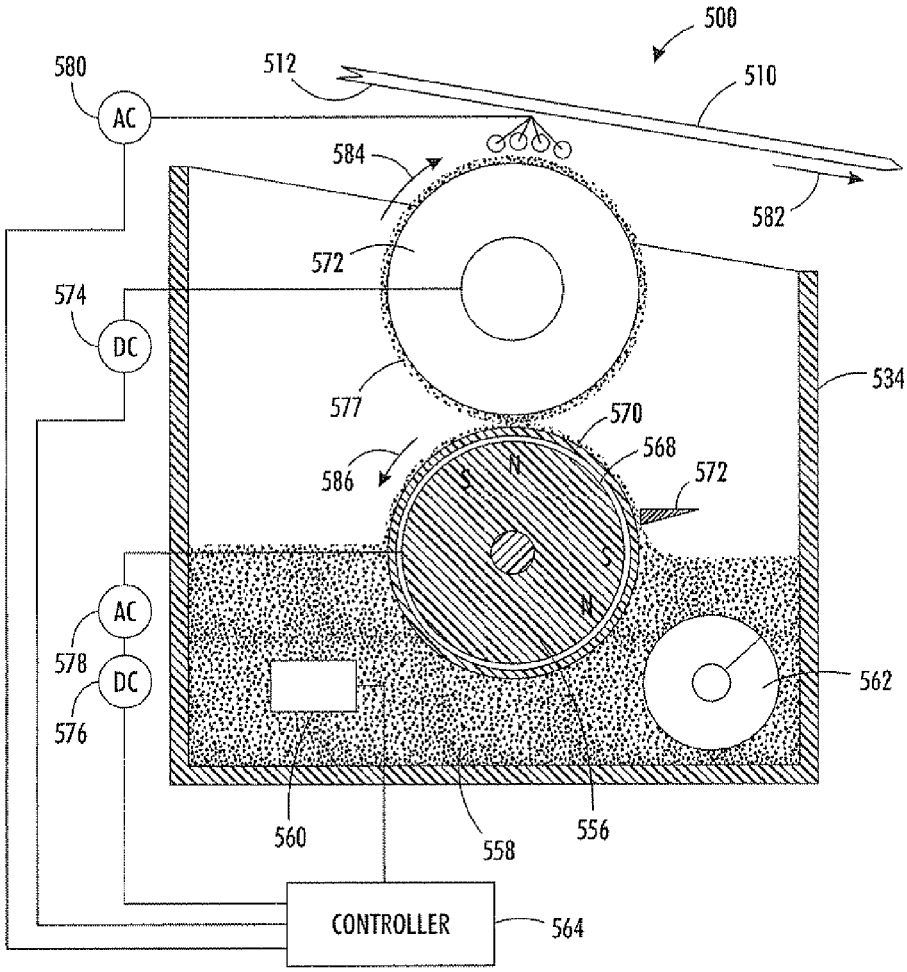
FIG. 5 shows a schematic view of a hybrid scavengeless development station.

FIG. 5 shows the image forming apparatus implemented in a Hybrid Scavengeless Development (HSD) station 500. A housing 534 can define a chamber for storing a supply of developer material 558 therein. Positioned in the bottom of the housing 534 can be a horizontal auger 562, which can distribute the developer material 558 uniformly along the length of a transport roll 556, so that the lowermost part of the transport roll 556 can be always immersed in a body of the developer material 558.

The transport roll 556 may include a stationary multi-polar magnet 568 having a closely spaced sleeve 570 of non-magnetic material, for example aluminum, designed to be rotated about the magnetic core 568 in either the "with" or "against" direction relative to a donor roll 572. The transport roll 556 is depicted as rotating in direction 586, in this case "against" the direction of rotation of the donor roll 572. The effect of the sleeve 570 rotating through stationary magnetic fields can be to cause the developer material 558 to be attracted to the exterior of the sleeve 570.

A blade 572 can be used to limit the radial depth of the developer material remaining adherent to sleeve 570 as it rotates towards the donor roll 536. The donor roll 536 can be rotated in either the "with" or "against" direction relative to the direction of motion of the belt 510. The donor roll 536 is depicted as rotating in direction 584, in this case "with" the direction of the motion direction 582 of the belt. The donor roll 536 can be kept at a specific voltage, by a DC power supply 574, to attract a thin layer of toner particles 577 from the transport roll 556 to the surface of the donor roll 536. The power supply 574 can be managed by the controller 564.

Either the whole of the donor roll 536, or at least a peripheral layer thereof, may be fabricated of a material that has low electrical conductivity. The material should be conductive enough to reduce or prevent any build-up of electric charge with time, and yet insulative enough to form a blocking layer to prevent shorting or arcing of the developer material 558 in a case where a two-component developer material is used or the donor roll 536.

The transport roll 556 can be biased by both a DC voltage source 576 and an AC voltage source 578. The effect of the DC electrical field can be to enhance the attraction of developer material 558 to sleeve 570. The effect of the AC electrical field applied along the transport roll 556 can be to loosen the toner particles 577 from their adhesive and triboelectric bonds to the carrier particles. A controller 564 can use a property detected by a sensor 560 to determine and set the potentials as described above.

Electrode wires 566 can be disposed in the space between the belt 510 and the donor roll 536. Four electrode wires 566 are shown extending in a direction substantially parallel to the longitudinal axis of the donor roll 536. The electrode wires 566 may be made from of one or more thin steel, stainless steel or tungsten wires that may be closely spaced from the donor roll 536. The diameter of the electrode wires 566 shown in the FIG. 5 is greatly exaggerated compared to the real wires for illustrative purposes. The distance between the electrode wires 566 and the donor roll 536 can be approximately the thickness of the toner layer 577 formed on the donor roll 536, or less.

The electrode wires 566 can be supported in close proximity to the ends of the donor roll 536. This support can locate the electrode wires 566 such that the electrode wires 566 and the donor roll 536 maintain a specific angular relationship. An alternating electrical bias can be applied to the electrode wires 566 by an AC voltage source 580. The applied AC can establish an alternating electrostatic field between the electrode wires 566 and the donor roll 536, which can detach toner particles 577 from the surface of the donor roll 536 and form a toner cloud about the electrode wires 566. As the belt 510 advances through the resulting toner cloud, the toner particles 577 are attracted to the latent image on the photoconductive surface 512.

Figure 6:
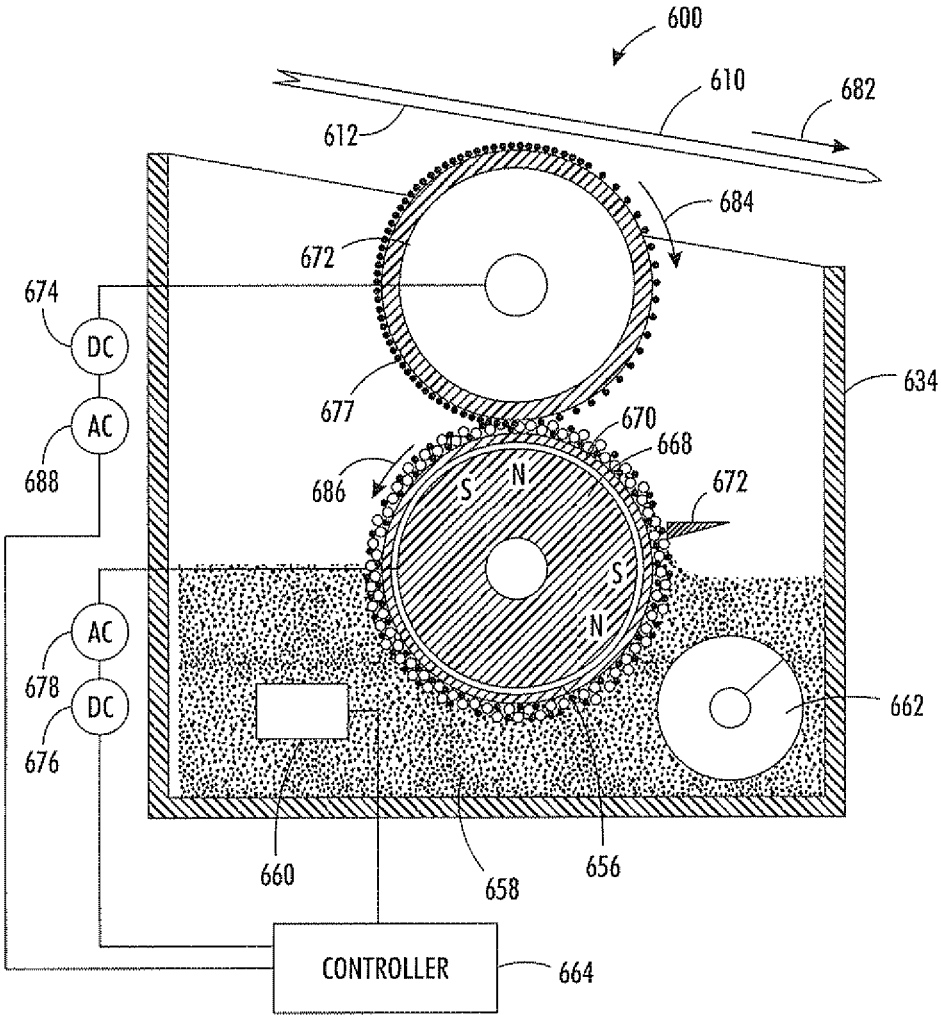
FIG. 6 shows a schematic view of a hybrid jumping development station.

FIG. 6 shows the image forming apparatus implemented in a Hybrid Jumping Development (MD) station 600. A housing 634 can define a chamber for storing a supply of developer material 658 therein. Positioned in the bottom of the housing 634 can be a horizontal auger 662, which can distribute the developer material 658 uniformly along the length of a transport roll 656, so that the lowermost part of the transport roll 656 can be always immersed in a body of the developer material 658.

The transport roll 656 may include a stationary multi-polar magnet 668 having a closely spaced sleeve 670 of non-magnetic material, for example aluminum, designed to be rotated about the magnetic core 668 in either the "with" or "against" direction relative to a donor roll 672. The transport roll 656 is depicted as rotating in direction 686, in this case "with" the direction of rotation of the donor roll 672. The effect of the sleeve 670 rotating through stationary magnetic fields can be to cause the developer material 558 to be attracted to the exterior of the sleeve 670.

A blade 672 can be used to limit the radial depth of the developer material remaining adherent to sleeve 670 as it rotates towards the donor roll 636. The donor roll 636 can be rotated in either the "with" or "against" direction relative to the direction of motion of the belt 610. The donor roll is depicted as rotating in direction 684, in this case "against" the direction of the motion of the belt.

The donor roll 636 can be biased by both a DC power supply 674 and an AC power supply 688. The effect of the DC electrical filed can be to attract a thin layer of toner particles 677 from the transport roll 656 to the surface of the donor roll 636. The effect of the AC electrical field can be to cause the toner particles 677 to jump off the donor roll 636 and onto the latent image on the photoconductive surface 612 as the belt 610 advances through development station 600. The power supplies 674 and 688 can be managed by the controller 664.

Either the whole of the donor roll 636, or at least a peripheral layer thereof, may be fabricated of a material that has low electrical conductivity. The material should be conductive enough to reduce or prevent any build-up of electric charge with time, and yet insulative enough to form a blocking layer to prevent shorting or arcing of the developer material 658 in a case where a two-component developer material is used or the donor roll 636.

The transport roll 656 can be biased by both a DC voltage source 676 and an AC voltage source 678. The effect of the DC electrical field can be to enhance the attraction of developer material 658 to sleeve 670. The effect of the AC electrical field applied along the transport roll 656 can be to loosen the toner particles 677 from their adhesive and triboelectric bonds to the carrier particles. A controller 664 can use property detected by a sensor 660 to determine and set the potentials as described above.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A developing station of an image forming apparatus, the developing station comprising:

a sensor configured to detect a property of a developer material residing in a housing;

a transport unit within the housing that is operatively in contact with the developer material residing in the housing, the transport unit being configured to move the developer material residing in the housing toward a recording medium outside the housing;

a power supply configured to apply a voltage to the transport unit; and a controller configured to receive the property of the developer material residing in the housing detected by the sensor and further configured to change, based upon the property of the developer material detected by the sensor, the voltage applied to the transport unit by the power supply, wherein:

the property of the developer material residing in the housing is toner age calculated as a mean residence time that toner resides in the housing, an alternating current potential may be set at a maximum potential when the toner age is less than a high threshold and the alternating current potential may be set at a nominal potential when the toner age is greater than a low threshold, and when toner age is between the high and the low thresholds, the controller can linearly decrease the alternating current potential as the toner age increases.

2. The developing station of claim 1, wherein the controller sets the voltage to a maximum when the property is less than a first property threshold, sets the voltage to a minimum when the property is greater than a second property threshold, and decreases the voltage linearly as the property increases when the property is between the first property threshold and the second property threshold.

3. The developing station of claim 1, wherein the controller decreases the voltage exponentially as the property increases.

4. The developing station of claim 1, wherein the controller decreases the voltage linearly as the property decreases.

5. The developing station of claim 1, wherein the property of the developer material residing in the housing is toner concentration in the housing.

6. A xerographic device comprising at least one of the developing station of claim 1.

7. A developing system for forming an image comprising:

a means for detecting a property of a developer material residing in a housing;

a means within the housing for moving the developer material residing in the housing towards a recording medium outside the housing;

a means for applying a voltage to the means for moving the developer material; and a means for changing the voltage applied to the means for moving the developer material by the means for applying a voltage based upon the property of the developer material residing in the housing detected by the means for detecting wherein the property of the developer material residing in the housing is toner age calculated as a mean residence time that toner resides in the housing, and wherein the means for changing the voltage sets an alternating current potential at a maximum potential when the toner age is less than a high threshold and sets the alternating current potential at a nominal potential when the toner age is greater than a low threshold, and when toner age is between the high and the low thresholds, the means for changing the voltage can linearly decrease the alternating current potential as the toner age increases.

8. The developing system for forming an image according to claim 7, wherein the means for changing the voltage sets the voltage to a maximum when the property is less than a first property threshold, sets the voltage to a minimum when the property is greater than a second property threshold, and decreases the voltage linearly as the property increases when the property is between the first property threshold and the second property threshold.

9. The developing system for forming an image according to claim 7, wherein the means for changing the voltage decreases the voltage exponentially as the property decreases.

10. The developing system for forming an image according to claim 7, wherein the means for changing the voltage decreases the voltage linearly as the property decreases.

11. The developing system for forming an image according to claim 7, wherein the property of the developer material residing in the housing is toner concentration.

12. A xerographic device comprising at least one of the developing system according to claim 7.

13. A method for developing an image comprising:

detecting with a sensor a property of a developer material residing in a housing;

moving with a transport unit the developer material residing in the housing towards a recording medium outside the housing;

applying with a power supply a voltage to the transport unit; and changing with a controller the voltage applied to the transport unit by the power supply based upon the property of the developer material residing in the housing detected by the sensor wherein the property of the developer material residing in the housing is toner age calculated as a mean residence time that toner resides in the housing, and wherein changing the voltage of the transport unit includes setting an alternating current potential at a maximum potential when the toner age is less than a high threshold, setting the alternating current potential at a nominal potential when the toner age is greater than a low threshold, and when toner age is between the high and the low thresholds, changing the voltage includes linearly decreasing the alternating current potential as the toner age increases.

14. The method for developing an image according to claim 13, wherein changing the voltage of the transport unit includes setting the voltage to a maximum when the property is less than a first property threshold, setting the voltage to a minimum when the property is greater than a second property threshold, and decreasing the voltage linearly as the property increases when the property is between the first property threshold and the second property threshold.

15. The method for developing an image according to claim 13, wherein changing the voltage of the transport unit includes decreasing the voltage exponentially as the property increases.

16. The method for developing an image according to claim 13, wherein changing the voltage of the transport unit includes decreasing the voltage linearly as the property increases.

17. The method for developing an image according to claim 13, wherein the property of the developer material residing in the housing is toner concentration in the housing.

18. A non-transitory computer readable medium configured to store a program for operating a developing station of an image forming apparatus, the program configured to cause the developing station to perform steps of:

detecting with a sensor a property of a developer material residing in a housing;

moving with a transport unit the developer material residing in the housing towards a recording medium outside the housing;

applying with a power supply a voltage to the transport unit; and changing with a controller the voltage applied to the transport unit by the power supply based upon the property of the developer material residing in the housing detected by the sensor wherein the property of the developer material residing in the housing is toner age calculated as a mean residence time that toner resides in the housing, and wherein changing the voltage of the transport unit includes setting an alternating current potential at a maximum potential when the toner age is less than a high threshold, setting the alternating current potential at a nominal potential when the toner age is greater than a low threshold, and when toner age is between the high and the low thresholds, changing the voltage includes linearly decreasing the alternating current potential as the toner age increases.

19. The developing station of claim 1, wherein the voltage applied to the transport unit by the power supply is an AC voltage.

20. The developing system for forming an image according to claim 7, wherein the voltage applied to the means for moving the developer material by the means for applying a voltage is an AC voltage.

21. The method for developing an image according to claim 13, wherein the voltage applied to the transport unit by the power supply is an AC voltage.

22. The non-transitory computer readable medium according to claim 18, wherein the voltage applied to the transport unit by the power supply is an AC voltage.

* * * * *